US005898959A

United States Patent [19]

Ricker

[11] Patent Number: 5,898,959

[45] Date of Patent: May 4, 1999

[54] FLOW-THROUGH SHOWER-BED WITH MOBILITY FEATURES

[75] Inventor: James W. Ricker, Harpswell, Me.

[73] Assignee: Michael L. Lockhart, Jersey City, N.J.

[21] Appl. No.: 08/941,432

[22] Filed: Sep. 30, 1997

[51] Int. Cl.[6] ..... A47K 3/22

[52] U.S. Cl. ..... 4/604; 4/560.1; 4/547; 5/600; 5/606

[58] Field of Search ..... 4/516, 523, 560.1, 4/571.1, 573.1, 575.1, 578.1, 579, 604, 611, 621, 605, 547; 5/600, 606, 625, 626, 928

[56] References Cited

U.S. PATENT DOCUMENTS

| | | | |
|---|---|---|---|
| 3,093,836 | 6/1963 | Christensen et al. | 5/600 |
| 3,758,894 | 9/1973 | Finley | 4/546 |
| 4,100,628 | 7/1978 | Franzl | 4/579 |
| 4,142,259 | 3/1979 | Moore | 4/661 |
| 4,207,629 | 6/1980 | Kagawa | 4/540 |
| 4,338,691 | 7/1982 | Gaffney | 4/562.1 |
| 4,974,905 | 12/1990 | Davis | 297/37 |
| 5,373,591 | 12/1994 | Myers | 4/560.1 |

*Primary Examiner*—David J. Walczak
*Attorney, Agent, or Firm*—Pierce Atwood; Chris A. Caseiro

[57] ABSTRACT

A shower-bed device that provides a high degree of self-mobility to a handicapped individual during showering. The device includes a platform with a water-resistant, non-slip padded surface with through-holes to allow water to flow therethrough. Large wheels with hand-rims provide the handicapped individual with a way to move the shower-bed. Small wheels that may pivot as well as rotate provide increased maneuverability. Adjustable-railings that prevent the handicapped individual from falling from the platform are also provided.

11 Claims, 4 Drawing Sheets

FLOW-THROUGH SHOWER-BED WITH MOBILITY FEATURES

BACKGROUND OF THE INVENTION

1. Field of Invention

The present invention relates to the field of bathing handicapped or otherwise incapacitated individuals. More particularly, the present invention relates to a device for providing such an individual a means by which he or she may safely bathe in a prone or supine position. More particular yet, the present invention includes a waterproof, non-slip padding on a raised platform. The padded platform has through-holes which allow water to flow therethrough during showering. The present invention provides for mobility of the individual for bathing purposes with or without assistance from others.

2. Description of Prior Art

In the field of bathing handicapped individuals, there have been numerous attempts to assist those individuals or those people who care for those individuals (e.g., nurses, home-care professionals, and the like) during either showering or immersion in a bath. Assorted mechanisms have been used in such prior-art attempts. Overall, the goal of these prior-art attempts has been to provide a safe and easy way to deal with maneuvering the handicapped individual into, out of, and within a tub or shower. Usually, these prior-art attempts involve two basic types of mechanisms. The first involves some form of specialized tub that is essentially a large, self-contained vessel that holds both bath-water and the individual to be bathed. The second involves some form of seat upon which the individual is placed and subsequently lowered into a standard tub or shower. However, neither type of prior-art device provides a safe and cost-effective mechanism to assist handicapped individuals in bathing regardless of assistance from others. Indeed, the complexity of such prior-art efforts has undercut whatever advantages they might otherwise offer. The time and effort involved in using complex and inefficient bathing-related devices is self-defeating. Other prior-art bathing-related devices have their own disadvantages.

One prior-art bathing-related device is that of Gaffney (U.S. Pat. No. 4,338,691), and involves a rectangular frame with a webbed seat for transporting individuals to and from a bathtub and for supporting them while in the tub. This prior-art device is limited to merely facilitating assistance of lighter-weight individuals such as children, and lacks any capacity for allowing the individual alone to operate the device without assistance from others. Thus, such a prior-art device fails to provide much versatility.

Another prior-art bathing-related device is that of Kagawa (U.S. Pat. No. 4,207,629). This prior-art device includes a rectangular frame similar to that of the device of Gaffney but differs in that the device of Kagawa is designed to hold water as opposed to being water-permeable. When full of water, however, the device of Kagawa is difficult to operate, as the quantity of water combined with the weight of the individual being bathed makes the device very heavy and unstable. As in the device of Gaffney, the device of Kagawa cannot be operated or made mobile solely by the individual being bathed. That is to say, the device of Kagawa cannot function for bathing an unassisted individual. In addition, the use of a tub which holds a substantial volume of water creates a safety hazard. This safety hazard may tragically result in the accidental drowning of an individual.

Still another prior-art bathing-related device is that of Finley (U.S. Pat. No. 3,758,894). The device of Finley includes a frame with four small wheels and a retractable guiderail. A chair is supported on the frame and is slidable along the guiderail when the guiderail is folded-out into a tub adjacent to the frame. This allows the chair to slide from beside the tub to above the tub. The device of Finley exhibits several flaws, including, most importantly, a lack of stability in securing an individual during bathing. When the chair is slid to its position above the tub, there are no handles or sides to maintain the individual in an upright position. Further, the fold-out guiderail is difficult to operate without assistance from others. Still further, the device of Finley suffers from the same deficiency seen throughout the prior art, i.e., the lack of mobility without assistance from others.

Accordingly, the prior art fails to provide any bathing-related device that allows an incapacitated individual to maneuver himself into, out of, and within a shower. Therefore, what is needed is a bathing-related device that provides a stable platform that can be easily wheeled around by an individual alone. What is also needed is such a bathing-related device that provides a safe platform surface that is both non-slip and does not accumulate water. Further, what is needed is such a device that secures the individual being bathed against undesirable movement or falls from the platform. It is important to note that the prior art fails to permit the individual to rest on the padding in any orientation; e.g., on his side, stomach, or back. Individuals with bedsores often cannot lay on their backs, and the prior art all essentially requires the individual to lay upon his back.

SUMMARY OF THE INVENTION

It is an object of the present invention to provide a bathing-related device in the form of a shower-bed that includes mobility features such that the individual user can move the shower-bed without the assistance of others. Another object of the shower-bed of the present invention is to provide a stable platform that prevents fall-related injuries therefrom to the individual. Yet another object of the present invention is to provide the shower-bed of the present invention with a platform that is both non-slip and allows water to flow therethrough. Still another object of the present invention is to provide mobility features that are manually operated by the individual without assistance by others. Optionally, it is also an object of the present invention to provide mobility features that are motorized or otherwise automatic and actuated by the individual.

The shower-bed device of the present invention includes a platform-base that is horizontally oriented with respect to a floor. Although, this discussion focuses on use of the present invention in terms of showering with water, any similar manner of use, e.g., rinsing with a decontamination fluid, is also contemplated for the present invention. Also, for purposes of illustration, the present invention is discussed in terms of a relatively flat platform; however, it should be understood that the platform is not intended to be limited to a linear surface, but may be contoured slightly so as to provide a more ergonomic fit for the handicapped individual, including, for example, a tilting capability of the upper portion of the platform where the user's head rests.

In addition to the platform-base, the present invention contains mobility features in the form of wheels located beneath the platform-base. Wheel supports project substantially perpendicularly from the underside of the platform-base and support wheel axles. The wheels may be relatively small (about six inches in diameter) or relatively large (about sixteen inches in diameter). Typically, the larger wheels will be located at one end of the platform-base and the smaller wheels at the other end. The larger type of wheel includes a hand-rim that allows the handicapped individual to manually rotate the wheel while lying horizontally, thus moving the entire shower-bed. The smaller wheels are useful when self-mobility is not needed or possible. Further, either type of wheel may be used with a self-contained and water-proofed electric motor. Such a motor would be actuated by a suitable control means such as, but not limited to, a joystick or a keypad. Wheel-locks are also desirable safety features that may be included in the shower-bed of the present invention.

The platform-base also includes a platform-cushion affixed to its top surface. Both the platform-base and the platform-cushion have through-holes which are aligned such that water (or any decontamination fluid) may easily flow therethrough. This prevents any collection of water atop the shower-bed which could lead to drowning, or, more likely, an accumulation of filth on the surface. The platform-cushion itself may be simply a flat thickness of cushion shaped to allow a user to be oriented most any way or may be more ergonomically formed. Moreover, the platform-cushion may be customized to the specific shape of any particular individual. Such a customization would help alleviate any pain that a contorted individual (e.g., rheumatoid arthritis sufferer) may experience while lying down flat. Further, the platform-cushion is preferably formed of a fast-drying and relatively water-resistant material that is non-slip. Materials such as dipped-vinyl, neoprene, or polypropylene are suitable for this purpose.

As a further safety feature, the shower-bed of the present invention includes an adjustable railing placed alongside the top surface of the shower-bed. Railing mounts are located on the platform-base such that they support one adjustable railing on each side of the shower-bed. Each adjustable railing may be raised or lowered within its respective railing mount. Any suitable means of retaining the adjustable railings in position may be used including, but not limited to, spring-actuated cotter push-buttons, cotter-pins, clamps, or motorized gearing. In the case of motorized gearing, linear actuation would occur through the use of worm gears and self-contained electric motors.

It is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

DETAILED DESCRIPTION OF THE PREFERRED EMBODIMENTS

Figure 1:
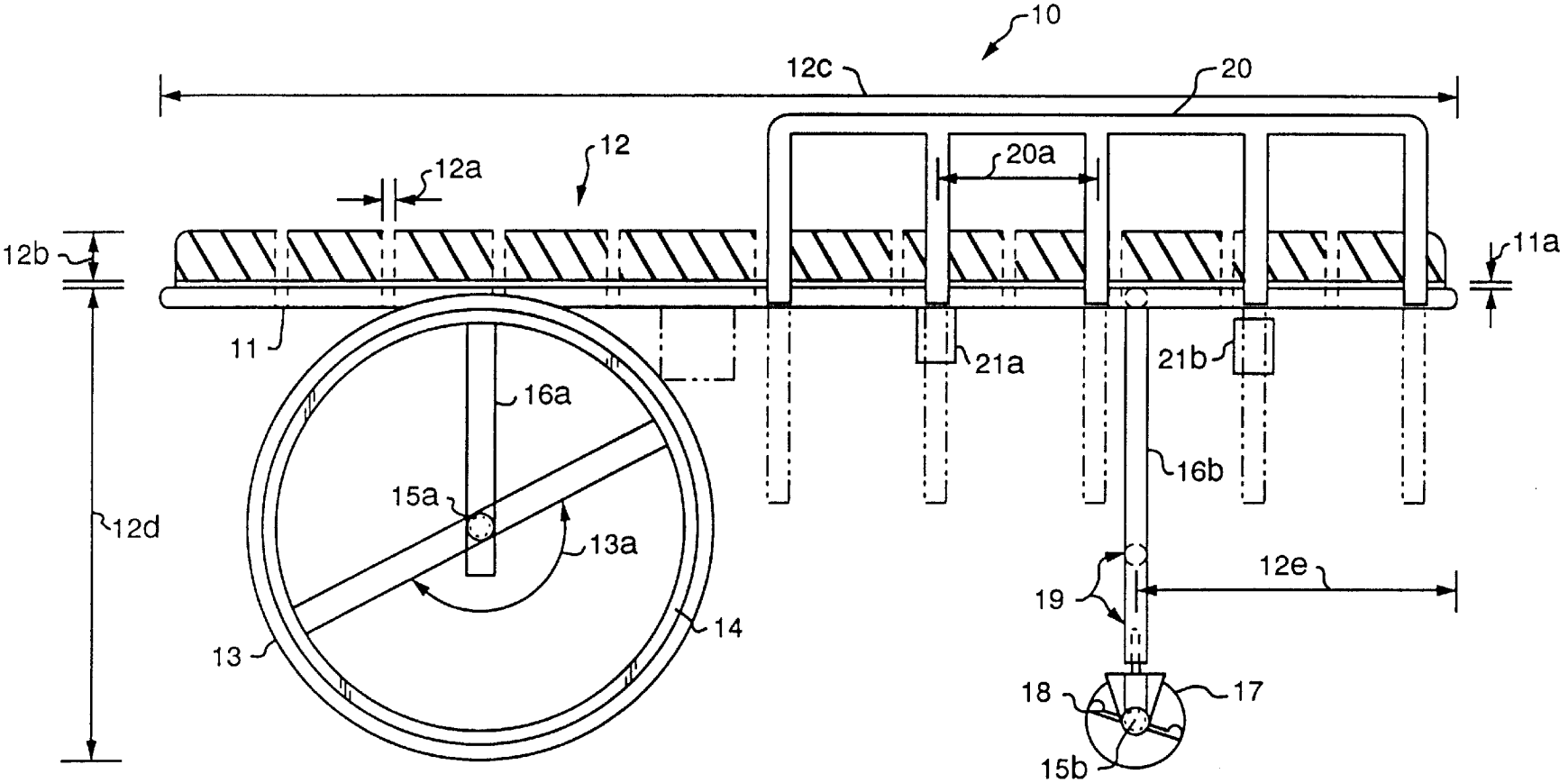
FIG. 1 is a side view of a shower-bed device in accordance with a first preferred embodiment of the present invention showing a large wheel of a large-wheel set and a small wheel of a small-wheel set.

In FIG. 1, a shower-bed device 10 is shown according to a first preferred embodiment of the present invention. While only two wheels are shown and discussed, it should be understood that there are actually two sets of wheels. The shower-bed device 10 includes primarily a platform-base 11, a large wheel 13, and a small wheel 17. A layer of adhesive 11*a* attaches a platform-cushion 12 to the platform-base 11. Through-holes 12*a* are located through the platform-base 11 and platform-cushion 12 and are aligned so that water or any fluid may pass therethrough. Optionally, the platform-base 11 can be fairly solid or have larger through-holes than those in the platform-cushion 12. The platform-cushion 12 is preferably made from a firmly-resilient material that does not absorb water and has a non-slip surface. It should be noted that the platform-cushion 12 is detachably affixed to the platform-base 11 so that it can be easily cleaned or replaced. A neoprene-coated foam material is preferred, although any suitable material may be used.

Figure 2:
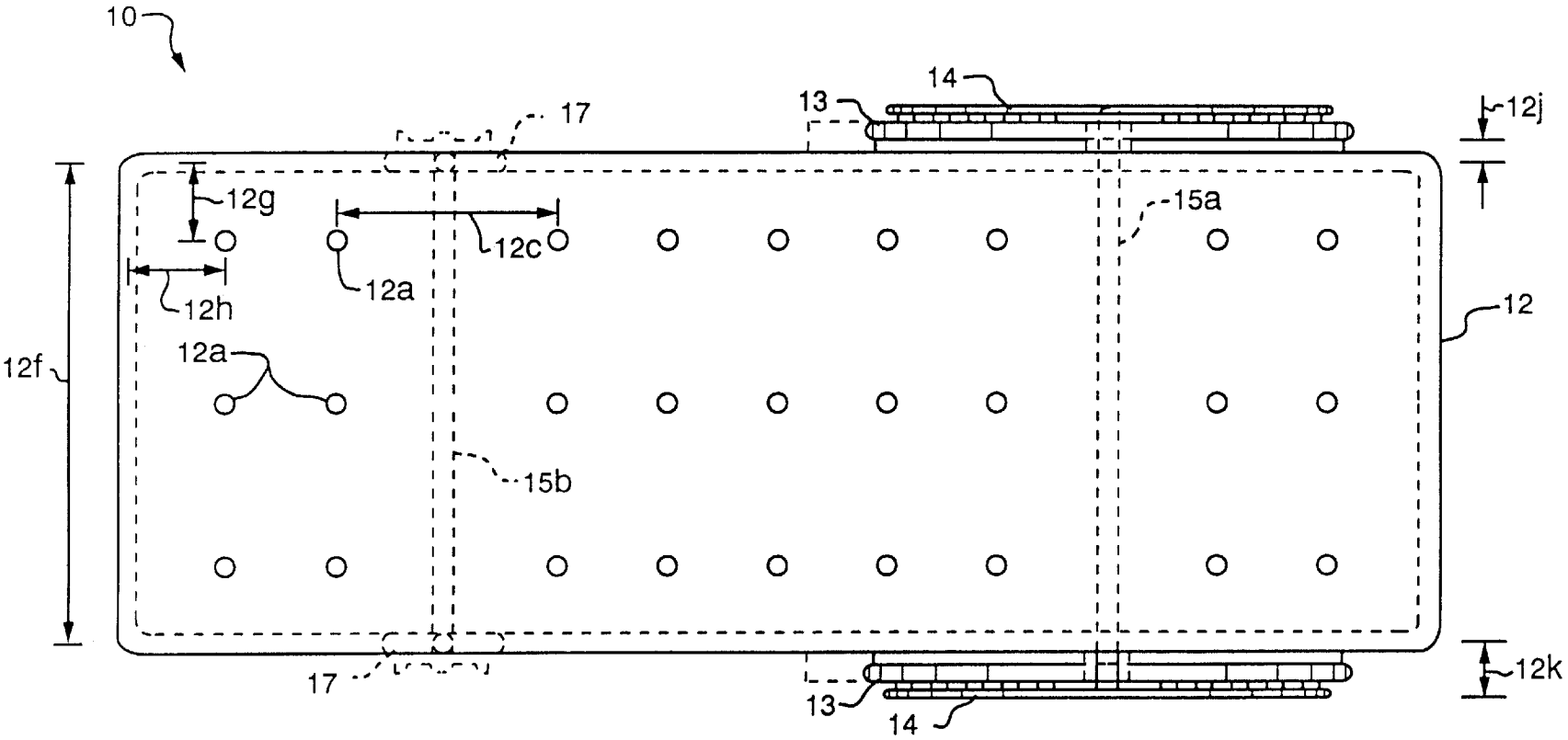
FIG. 2 is a top view of the shower-bed device as shown in FIG. 1.
Figure 3:
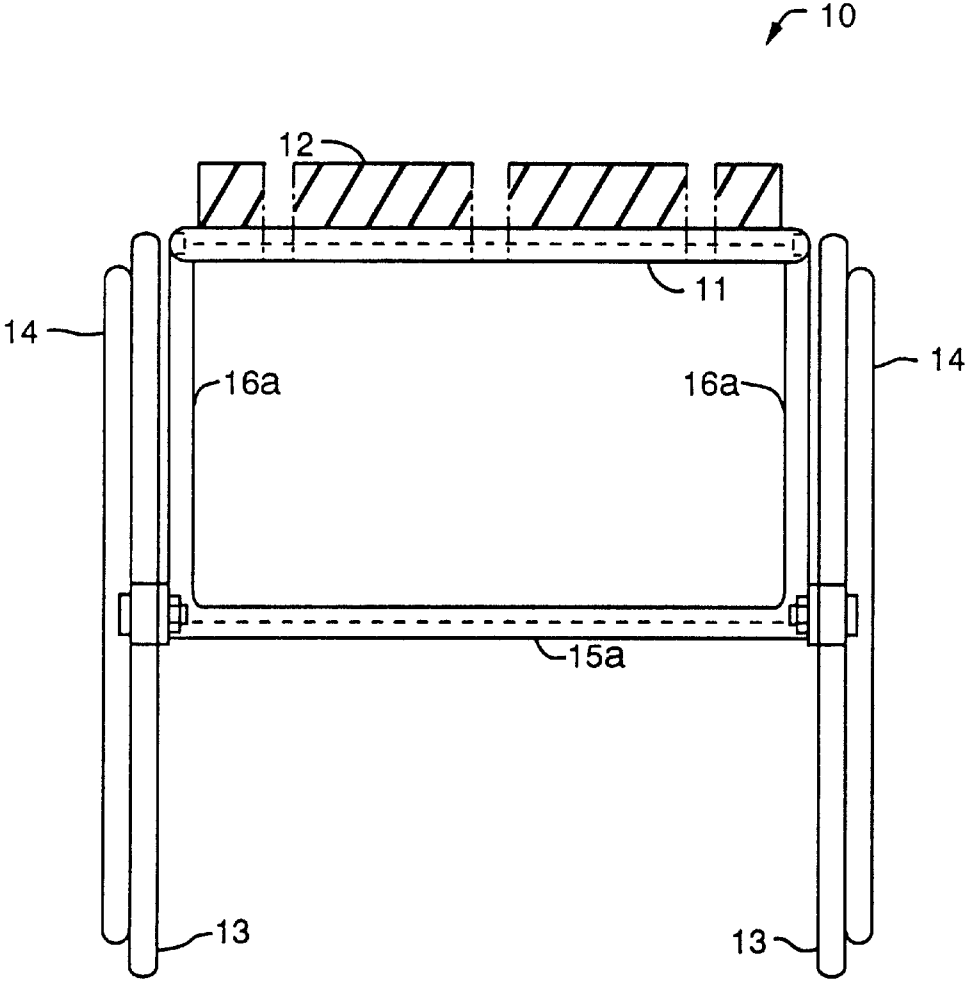
FIG. 3 is lengthwise view of the shower-bed device as shown in FIG. 1 taken from the left side of FIG. 1.

Although only one side of the shower-bed device 10 is shown in FIG. 1, it should be understood that the other side (hidden from view) includes the same structures as shown in FIG. 1. FIGS. 2 and 3 show the doubling of like parts. Accordingly, there is preferably a total of four wheels, two large and two small. The large wheel 13 is preferably 24 inches in diameter and includes at least one spoke 13*a* although several spokes or even a solid disk may be used to support the large wheel 13. The spoke 13*a* is attached to an axle 15*a* which, in turn, is attached to a wheel-support 16*a* affixed to the underside of the platform-base 11. The large wheel 13 also includes a hand-rim 14 that facilitates manual rotation of the large wheel 13 which provides mobility to the shower-bed device 10. It is important to note that such mobility is possible by the individual who is reclined upon the shower-bed device 10 without any assistance from others. The small wheel 17 is preferably about six inches in diameter and includes a wheel-lock 18. The small wheel 17 is supported by a wheel-support 16*b* that is attached to the underside of the platform-base 11. A small independent-axle 15*b* is attached to the end of the wheel-support 16*b* to allow rotational movement of the small wheel 17. A pivoting-element 19 is located within wheel-support 16*b* so as to provide the small wheel 17 with pivoting capability, thus increasing movement and control of the shower-bed 10.

With reference to FIGS. 1 and 2, the spacing of parts is now discussed. Each through-hole 12*a* is about an inch in diameter so as to allow sufficient flow of fluid therethrough and prevent any accumulation of fluid. It should be noted that greater or fewer through-holes may be needed depending on the diameter of the through-holes used. However, each through-hole is preferably small, e.g., one-inch in diameter. A platform-cushion thickness 12*b* is selected to provide a good amount of resilient cushioning, preferably about an inch or two. For structural integrity and overall balance of the shower-bed device 10, dimensions 12*e–k* are chosen so as to provide a very solid structure and a very stable wheel-base.

As a further safety feature, the shower-bed 10 as seen In FIG. 1 includes an adjustable-railing 20 placed along each side of the shower-bed 10. Railing-mounts 21*a* and 21*b* are located on the platform-base 11 such that they support each adjustable-railing 20. Each adjustable-railing 20 may be raised or lowered within their respective railing-mount 21*a* or 21*b*. While any suitable means of retaining the adjustable-railing 21 may be used, it is preferred that conventional spring actuated cotter push-buttons (not shown) be used and operated manually. The rail-spacing 20*a* is selected to prevent an individual from becoming stuck within the adjustable-railing 20.

Figure 4:
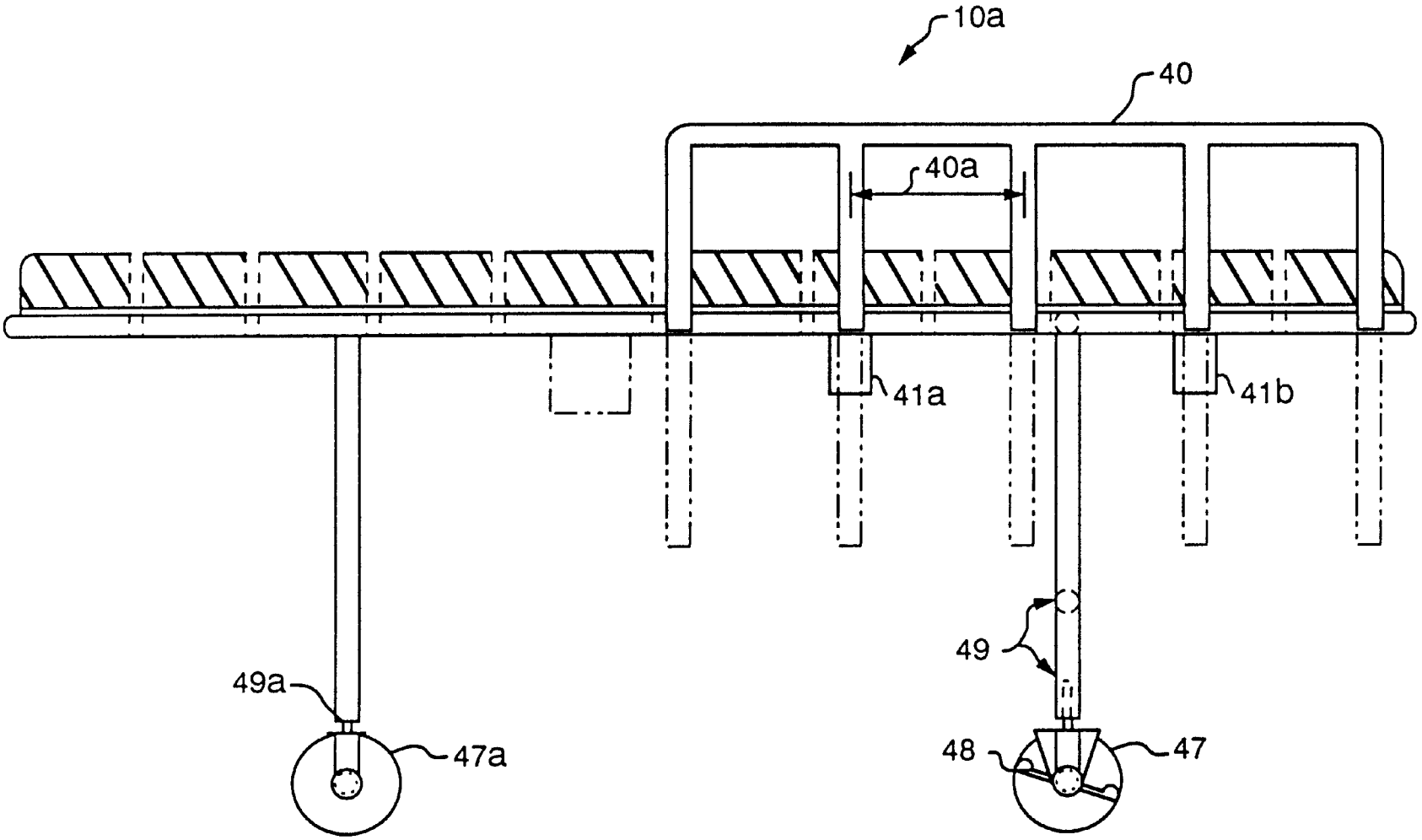
FIG. 4 is a side view of a shower-bed device in accordance with a second preferred embodiment of the present invention, showing two small wheels of two small-wheel sets.

A second preferred embodiment of the present invention is shown in FIG. 4. The second embodiment 10*a* differs from the first preferred embodiment 10 only in that four small wheels 47 (two shown, two hidden) are used and no large wheels are used. Such an embodiment 10*a* is useful only when self-mobility is not desired or possible. In FIG. 4, there is a pivoting wheel 47 with a pivot-element 49 and a wheel-lock 48. Also, there is a non-pivoting wheel 47*a* fixedly attached to a non-pivoting wheel-support 49*a*. Further, an adjustable-railing 40 and railing-mounts 41*a* and 41*b* are included with proper rail-spacing 40*a*.

It should be understood that the preferred embodiments mentioned here are merely illustrative of the present invention. Numerous variations in design and use of the present invention may be contemplated in view of the following claims without straying from the intended scope and field of the invention herein disclosed.

I claim:

1. A shower-bed device designed to permit a user to move into and out of a showering facility, and to bathe, without assistance from others, said shower-bed device comprising:

a) an elongated platform, said platform having a platform-base and a platform-cushion, wherein said platform includes through-holes extending completely through said platform-cushion and said platform-base, and wherein said through-holes are aligned through said platform-cushion and said platform-base;

b) a first pair of wheels for rotational movement, said first pair of wheels located beneath a first end of said platform; and c) a second pair of wheels for both rotational movement and pivotal movement, said second pair of wheels located beneath a second end of said platform;

wherein said first pair of wheels and said second pair of wheels maintain said platform in a horizontal position relative to a floor surface located immediately under said first pair of wheels and said second pair of wheels, and wherein said platform, said first pair of wheels, and said second pair of wheels are arranged in combination to enable the user to wheel said shower-bed device into and out of a showering facility without assistance from others.

2. The shower-bed device as claimed in claim 1, wherein said platform-base includes two sets of railing mounts located on either side of said second end of said platform.

3. The shower-bed device as claimed in claim 2, said shower-bed further including a pair of adjustable railings wherein each said set of railing mounts adjustably supports a respective one of said pair of adjustable-railings.

4. The shower-bed device as claimed in claim 3, wherein said first pair of wheels includes two large wheels sized such that an outermost diameter of each of said two large wheels is substantially equal to a distance from said bottom surface of said platform to said floor surface, each of said two large wheels having a hand-rim that allows for manual rotation of each of said two large wheels independently of one another.

5. The shower-bed device as claimed in claim 4, wherein said second pair of wheels includes two small wheels, each of said two small wheels being less than twelve inches in diameter and attached to said bottom surface of said platform via a wheel-support, each of said two small wheels being both pivotable about said wheel-support via a pivoting-element and rotatable about an axle within an end of said pivoting-element.

6. The shower-bed device as claimed in claim 5, wherein each of said two small wheels includes a wheel-lock for preventing rotational movement of each of said two small wheels.

7. The shower-bed device as claimed in claim 6, wherein said platform-cushion is made from a water-resistant, non-slip material.

8. A shower-bed device designed to permit a user to move into and out of a showering facility, and to bathe, without assistance from others, said shower-bed device comprising:

a) a platform for providing a top surface sufficiently sized to support a substantially horizontally-oriented human body, said platform having a platform-base and a water-resistant, non-slip platform-cushion detachably affixed atop said platform-base, said platform having through-holes extending completely through said platform-cushion and said platform-base, and wherein said through-holes are aligned through said platform-cushion and said platform-base b) a first pair of wheels for rotational-only movement; and c) a second pair of wheels for both rotational and pivotal movement, said second pair of wheels being of a smaller diameter than said first pair of wheels;

wherein said first pair of wheels and said second pair of wheels are affixed to said platform and located at opposite ends thereof, wherein said first pair of wheels and said second pair of wheels maintain said platform in a position parallel to a floor surface located immediately under said first pair of wheels and said second pair of wheels, and wherein said platform, said first pair of wheels, and said second pair of wheels are arranged in combination to enable the user to wheel said shower-bed device into and out of a showering facility without assistance from others.

9. The shower-bed device as claimed in claim 8, wherein said platform-base includes two sets of railing mounts located on either side of said second end of said platform, and a pair of adjustable railings wherein each said set of railing mounts adjustably supports a respective one of said pair of adjustable railings.

10. The shower-bed device as claimed in claim 9, wherein said first pair of wheels is sized such that an outermost diameter of each wheel of said first pair is substantially equal to a distance from said bottom surface of said platform to said floor surface, each wheel of said first pair having a hand-rim that allows for manual rotation of each wheel of said first pair independently of one another, and said second pair of wheels is attached to said bottom surface of said platform via a wheel-support, each of said two small wheels being both pivotable about said wheel-support via a pivoting-element and rotatable about an axle, said axle located within an end of said pivoting element.

11. The shower-bed device as claimed in claim 10, wherein each of said second pair of wheels includes a wheel-lock for preventing rotational movement of each wheel of said second pair of wheels.

* * * * *